United States Patent [19]

Kahler

[11] 4,041,960

[45] Aug. 16, 1977

[54] LIQUID FILTERED SMOKING DEVICE

[76] Inventor: Richard W. Kahler, Rte. 1, Box 61, Rock Cave, W. Va. 26234

[21] Appl. No.: 601,826

[22] Filed: Aug. 4, 1975

[51] Int. Cl.[2] ..... A24F 1/30

[52] U.S. Cl. ..... 131/173; 131/221; 131/224

[58] Field of Search ..... 131/273, 221, 229, 205, 131/224

[56] References Cited

U.S. PATENT DOCUMENTS

| | | | |
|---|---|---|---|
| 473,212 | 4/1892 | Dannenberg | 131/224 |
| 1,229,943 | 6/1917 | Graham et al. | 131/173 |
| 1,505,861 | 8/1924 | Carafilidis | 131/173 |
| 3,804,100 | 4/1974 | Fariello | 131/173 |
| 3,872,872 | 3/1975 | Kahler | 131/173 |
| 3,889,690 | 6/1975 | Guarnieri | 131/173 X |

*Primary Examiner*—Stephen C. Pellegrino

*Attorney, Agent, or Firm*—Schwartz & Weinrieb

[57] ABSTRACT

A liquid filtered smoking device including a container having an opening, hollow at one end thereof, and having a liquid filtering medium therein, and a hollow, preferably cylindrical, tube, open at both ends, inserted through the peripheral wall of the container such that the lower end of the tube is immersed within the liquid filtering medium while the upper end of the tube projects outwardly from the container. A smoking bowl, having smoking tobacco deposited therein is secured upon the upper end of the tube and a filter is adapted to be inserted within the bowl in order to prevent tobacco ash and unburnt or partially burnt tobacco particles from passing through the tube and into the liquid filtering medium. The bowl may be either of the reversible or non-reversible type and the filter may be utilized in conjunction with both types of bowls.

10 Claims, 7 Drawing Figures

LIQUID FILTERED SMOKING DEVICE

BACKGROUND OF THE INVENTION

1. Field of the Invention

The present invention relates generally to smoking devices, and more particularly to an improved liquid filtered smoking device which is particularly useful for the smoking of rare and expensive tobaccos.

2. Description of the Prior Art

While an innumerable variety of liquid filtered smoking devices are known, wherein the smoking tobacco is disposed within a bowl or container supported upon the upper end of a tube, the lower end of the tube being immersed within the filtering liquid contained within a suitable container, and wherein smoke is drawn from the tobacco compartment or chamber defined within the bowl or container, through the tube and filtering liquid, and ultimately withdrawn from the container, it has been experienced that, as the tobacco compartment is fluidically connected to the aforenoted tube and filtering liquid by means of, for example, a suitable orifice provided within the tobacco bowl or container, so as to permit the smoke to pass therethrough, tobacco ash, as well as small particles of unburnt or partially burnt tobacco, can likewise pass through the aforenoted orifice and become deposited within the filtering liquid.

As might thus be expected, such deposition of tobacco ash and unburnt tobacco particles within the filtering liquid defiles and pollutes the same, and quite naturally, adversely affects the filtering capacity and efficiency of the device whereby the quality of the smoke withdrawn therefrom is undesirably compromised. In addition, as unburnt or partially burnt tobacco is conventionally permitted to pass through the orifice within the tobacco bowl or container and ultimately deposited within the filtering liquid, recovery of the same for subsequent burning or combustion is negatived and considerable wastage of tobacco occurs.

OBJECTS OF THE INVENTION

Accordingly, it is a significant object of the present invention to provide an improved liquid filtered smoking device.

Another object of the present invention is to provide an improved liquid filtered smoking device which overcomes the aforenoted drawbacks of conventional liquid filtered smoking devices.

Still another object of the present invention is to provide an improved liquid filtered smoking device which is peculiarly simple and inexpensive to manufacture.

Yet another object of the present invention is to provide an improved liquid filtered smoking device which is uniquely suited for the smoking of rare and expensive tobaccos.

A further object of the present invention is to provide an improved liquid filtered smoking device which includes a reversible bowl or container which is capable of retaining a small or large amount of smoking tobacco at the user's option.

A still further object of the present invention is to provide an improved liquid filtered smoking device which includes a uniquely simple filter for preventing tobacco ash and unburnt or partially burnt tobacco from becoming deposited within the filtering liquid.

An additional object of the present invention is to provide an improved liquid filtered smoking device wherein the filter may be disposed or incorporated within either end of the reversible bowl or tobacco container in order to permit the large or small amount of tobacco being smoked to nevertheless be filtered.

A yet further object of the present invention is to provide an improved liquid filtered smoking device wherein the filter may be disposed above or below the bowl so as to trap or retain the tobacco ash and unburnt or partially burnt tobacco particles therein, and when disposed below the bowl, may subsequently be removed from its original position within the smoking device and disposed above the bowl so as to recover the unburnt or partially burnt tobaccos and permit further combustion thereof.

A still yet further object of the present invention is to provide an improved liquid filtered smoking device which includes a non-reversible bowl and a filter incorporated therewithin for the aforenoted purposes.

BRIEF SUMMARY OF THE INVENTION

The foregoing and other objectives are achieved according to the present invention through the provision of a liquid filtered smoking device which includes a container having an opening at one end thereof so as to retain a liquid filtering medium therein, and a hollow, preferably cylindrical, tube open at both ends, and inserted through the peripheral wall of the container such that the lower end of the tube is immersed within the liquid filtering medium while the upper end of the tube projects outwardly and away from the first tube. A smoking bowl containing tobacco deposited therein to be smoked, is secured upon the upper end of the tube and a filter is adapted to be inserted within the bowl so as to prevent tobacco ash and unburnt or partially burnt tobacco particles from passing through the second tube into the liquid filtering medium. The bowl containing the tobacco may be of the reversible or the conventional non-reversible type and the filter may be utilized in conjunction with both types of bowls.

BRIEF DESCRIPTION OF THE DRAWINGS

Various other objects, features and attendant advantages of the present invention will more fully be appreciated as the same becomes better understood from the following detailed description when consideration is given to the accompanying drawings, wherein like reference characters designate like or corresponding parts throughout the several views, and wherein.

DETAILED DESCRIPTION OF THE PREFERRED EMBODIMENTS

Figure 1:
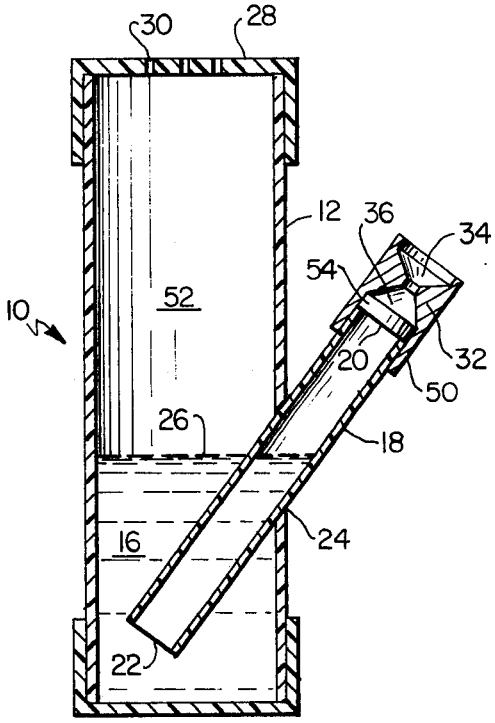
FIG. 1 is a longitudinal cross-section view of an assembled liquid filtered smoking device constructed in accordance with the present invention and showing its cooperative parts.

Referring now to the drawings, and more particularly to FIG. 1 thereof, there is shown a liquid filtered smoking device, generally indicated by the reference character 10, which includes a container 12 which is preferably a vertically disposed, hollow, cylindrical tube normally open at both its upper and lower ends, a cup type closure cap 14 substantially U-shaped in cross-section, being secured however, upon the lower end of tube 12 so as to permit a liquid filtering medium 16 to be retained therewithin. It is of course quite apparent that the fitting between cap 14 and the lower end of tube 12 is to be liquid tight, and the same may be readily achieved by fabricating cap 14 of a suitable plastic or rubber material, the fitting between cap 14 and tube 12 being, for example, a friction type fitting. A second, hollow, cylindrical tube 18, which is also normally open at both its upper and lower ends 20 and 22, respectively, is inserted through an aperture 24 provided within the periphery of tube 12 such that tube 18 is secured within tube 12 by means of, for example, a friction fit, in an inclined manner relative to the longitudinal axis of tube 12. It is understood that container 12, as illustrated in the drawings, merely illustrates one type of container useful in the practice of this invention. Other types of containers including those of the fish bowl style, as taught in U.S. Pat. 3,863,646, can also be used in the practice of this invention.

The liquid 16 may be any suitable filtering medium, such as for example, water, wine or the like, and a sufficient amount of such liquid is deposited within container 12 such that the lower end 22 of tube 18 is fully immersed therein. While the amount of liquid 16 need not be precisely determined, the level 26 of the liquid should reach a height of approximately one-half the height of both the container 12, as well as the tube 18, in order to provide a filtering medium of adequate capacity, although if even a greater amount of filtering medium is desired, the bottom closure cap 14 may be removed and the entire device deposited directly into the open end of a conventional fish bowl, as shown for example, within U.S. Pat. No. 3,863,646.

An additional closure cap 28, which is similar to cap 14, may be secured to the upper end of tube 12, and a plurality of orifices 30 are provided within cap 28 so as to permit smoke to be withdrawn from the device 10 by the user in a conventional manner, although cap 28 may be considered optional and entirely discarded, the user withdrawing the smoke directly through the upper open end of tube 12, as will become more apparent hereinafter. A smoking bowl, generally indicated by the reference character 32, is adapted to be secured upon the upper end 20 of tube 18 by means of, for example, a friction type fitting, the internal diameter D of the bowl being slightly larger than the external diameter of tube 18, and the bowl 32 is preferably of the reversible type, as best seen for example, within FIG. 2, or the non-reversible type, as best seen for example, within FIG. 3. As will be apparent, the reversible bowl 32 includes a first, small tobacco compartment 34 and a second, large tobacco compartment 36, while the non-reversible bowl simply includes a small compartment 34. The preferred reversible bowl is disclosed in U.S. Pat. Nos. 3,863,646 and 3,872,872.

Figure 2:
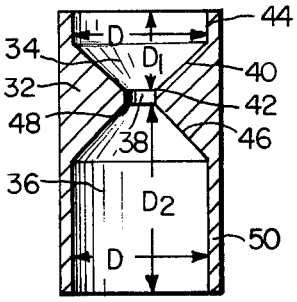
FIG. 2 is a longitudinal cross-section view of a reversible smoking bowl which may be utilized within the assembly of FIG. 1.
Figure 3:
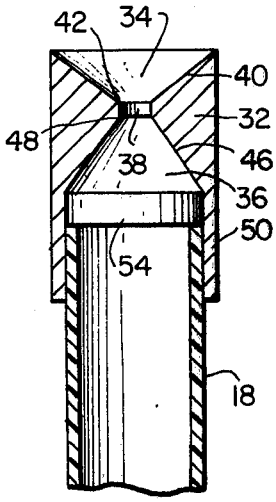
FIG. 3 is a partial cross-section view of the apparatus of FIG. 1, wherein a non-reversible smoking bowl is illustrated which may be utilized within the assembly illustrated in FIG. 1.

Referring more particularly to FIGS. 2 and 3, the details of the smoking bowls 32 may become quite apparent. With respect to the reversible bowl of FIG. 2, small and large tobacco compartments 34 and 36, respectively, are defined within bowl 32 so as to be oppositely disposed relative to one another in a back-to-back manner, the compartments being fluidically connected by means of a central orifice 38. The small compartment 34 is defined by means of a lower frusto-conical portion 40 of bowl 32, the apex 42 of which is integrally connected with the upper portion of the peripheral wall of the bowl defining orifice 38, and an upstanding annular ring portion 44 integrally connected to frusto-conical portion 40. Similarly, the large compartment 36 is defined by means of an upper frusto-conical portion 46 of bowl 32, the apex 48 of which is similarly integrally connected with the lower portion of the peripheral wall of the bowl defining orifice 38, and a dependent annular ring portion 50 integrally connected to frustoconical portion 46. The longitudinal extent of ring portion 50 is substantially greater than that of portion 44, and consequently, the depth of the large compartment 36 may be schematically designated $D_2$ while that of small compartment may be designated $D_1$ wherein $D_2 > D_1$.

With particular reference to FIG. 3, the non-reversible smoking bowl is seen to be identical to the reversible smoking bowl except that only a single smoking compartment 34 is defined therein. It is apparent that when either end of the reversible bowl of FIG. 2 is secured upon tube 18, either by means of annular ring member 50 or annular ring member 44, the other or remaining compartment becomes the smoking compartment within which the tobaccos are disposed. With the non-reversible smoking bowl of FIG. 3, however, as the annular ring member or portion 44 has been deleted, the bowl may only be secured upon tube through the interfitting accomplished between ring member 50 and tube 18, and consequently, only a single smoking compartment 34 is provided for use.

In operation, the smoking tobacco is deposited within either of the compartments 34 or 36 of the smoking bowl 32, depending upon the type of bowl used, as well as the amount of tobacco desired, and after the tobacco is ignited, the user places his mouth over the holes 30 or cap 28, or if cap 28 has been discarded, the user places his mouth directly over the upper open end of container 12. Upon inhaling, a partial vacuum is created within region 52 of tube 12, and smoke from the burning tobacco will be drawn through orifice 38 and will continue down through tube 18 and into liquid 16 through the open end 22 of tube 18. The smoke then filters through liquid 16 and continues upward through container 12, passing through the liquid level line 26 and region 52 of container 12, and into the user's mouth.

As the orifice 38 is large enough to permit smoke to pass therethrough in the aforenoted manner, while small enough to retain substantially most of the tobacco within the appropriate smoking compartment, it has been experienced that the tobacco ashes and some of the smoking tobacco, either in the unburnt or in the partially burnt state, are permitted to pass through orifice 38 along with the induced smoke. The passage of such ash and tobacco material through orifice 38 is quite undesirable, however, as may be readily appreciated, because such materials defile and pollute the filtering medium 16 whereby the filtering efficiency thereof is substantially reduced and the quality of the smoke inhaled by the user is undesirably compromised.

Consequently, in order to prevent the passage of ash and tobacco material through tube 18 and the deposition of such materials within medium 16, a filter generally indicated by the reference character 54 may be disposed upon the open upper end of tube 18 and retained within such seated position by means of bowl 32. The diameter of the filter 54 is substantially the same as that of tube 18 and because the depth of the filter 54 is substantially less than the depth of the ring portion 50 of bowl 32, the filter may be deposited within the lower compartment 36 of bowl 32 and subsequently, the filter-bowl assembly may be deposited upon the upper end of tube 18. In this manner, as ash and tobacco materials fall through orifice 38, the same will be collected upon or within filter 54 and thereby prevented from passing through tube 18 and becoming deposited within medium 16.

Figure 4:
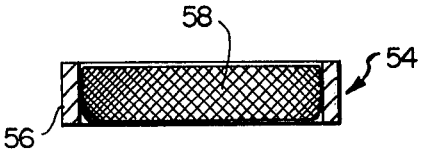
FIG. 4 is a cross-section view of one embodiment of a filter device which may be utilized within the assembly of FIG. 1.
Figure 5:
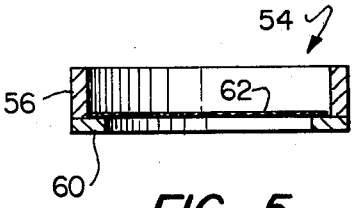
FIG. 5 is a view similar to that of FIG. 4, illustrating however, another embodiment of the filter device.

With particular reference now being made to FIG. 4, the filter 54, in accordance with one embodiment thereof, may comprise an annular ring member 56 and a cup-shaped wire mesh screen member 58 secured within member 56 by means of, for example, a friction fit. Alternatively, as best seen in FIG. 5, another embodiment of filter 54 may include an annular ring member 56 which is provided, at its lower portion thereof, with an integrally formed, radially inwardly projecting annular ring portion 60. In lieu of the cup-shaped screen member 58, a flat disc-type screen member 62, preferably wire screen mesh, may simply be deposited within member 56, the diameter of member 62 being sufficiently small so as to permit the deposition of member 62 within ring member 56, yet the diameter of member 62 is sufficiently large so as to permit seating of the same upon ring portion 60. When wire screen mesh is used as the filter element, the mesh size is of a size sufficient to prevent passage of tobacco ash and unburnt or partially burnt tobacco particles therethrough.

In use with the smoking device of the present invention, when the filter 54 is to be in combination with a non-reversible bowl, as seen, for example, within FIG. 3, the filter 54 must of necessity be disposed within the large compartment 36 and seated upon the upper end of tube 18, as the non-reversible bowl is not provided with an upstanding ring member 44 so as to define a cylindrical cavity for seating the filter. Tobacco may then be deposited within smoking compartment 34 and the ash and tobacco particles passing through orifice 38 may be entrapped upon or within filter 54 in a well-known manner.

Figure 6:
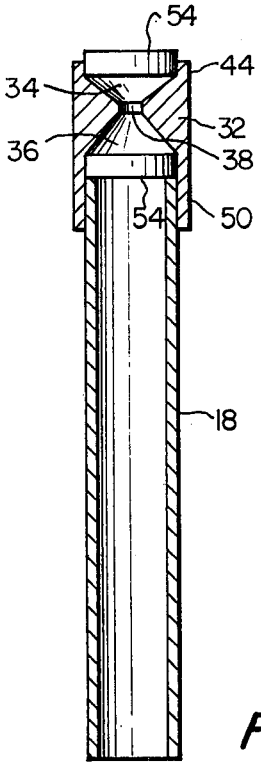
FIG. 6 is a view similar to that of FIG. 3, wherein a reversible smoking bowl, using a small quantity of tobacco, is shown which may be utilized within the device of FIG. 1.

When using the filter in conjunction with a reversible bowl, and tobacco is deposited within the small compartment 34, as seen for example within FIGS. 1 and 6, the filter 54 may be seated upon the upper end of tube 18 and within the large compartment 36 as in the case of the nonreversible bowl. It is to be noted that as the tobacco within compartment 34 is burned, and the quantity of such tobacco within compartment 34 diminishes, while ash and unburnt or partially burnt tobacco collects within filter 54, the filter may be removed from compartment 36 and placed within the upper part of bowl 32 and within compartment 34, as seen in FIG. 6, so as to permit the recovery of such unburnt or partially burnt tobacco and facilitate further combustion thereof. In addition, in order to further prevent other ash and tobacco particles from entering tube 18 and medium 16, a second, preferably clean filter 54 may be deposited within the lower compartment 36 of bowl 32 and seated upon the upper end of tube 18, all in the manner as described heretofore. In this manner, the original tobacco within compartment 34 continues to burn, unburnt and partially burnt tobacco has been recovered for still additional combustion and smoking pleasure, and residue particles are nevertheless prevented from entering tube 18 and medium 16. After complete combustion of the tobacco, the filter may of course be removed for replacement and/or cleaning purposes.

Figure 7:
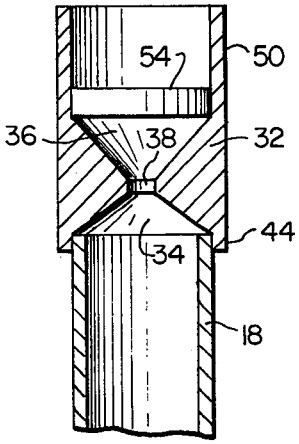
FIG. 7 is a view similar to that of FIG. 6, wherein however, a large quantity of tobacco is shown that may be utilized within the assembly of FIG. 1.

When the filter is desired to be used in conjunction with a large amount of tobacco to be burned and smoked, the components may be arranged in accordance with the embodiment illustrated within FIG. 7. In this manner, the tobacco is placed within the large, upper compartment 36, the bowl 32 being supported upon the upper end of tube 18 through means of the friction fit defined between tube 18 and ring member 44 of the lower compartment 34. Since the depth of ring member 44 is insufficient to permit the filter 54 to be seated therein while nevertheless facilitating the friction fit with tube 18, filter 54 is deposited within compartment 36 and the tobacco is in fact placed upon and above the screen member of the filter. Thus, the ash and tobacco particles collect immediately upon filter 54 without even passing through orifice 38.

It is understood, however, that the depth of ring member 44 can also be of sufficient depth to facilitate placement of filter 54 on the upper end of tube 18 and within the small compartment 34. Thus, reversible bowls containing both large and small tobacco compartments wherein each of said compartments contain annular ring portions of a size sufficient to permit placement of filter 54 on the upper end of tube 18 and within both large and small compartments, can be used in the practice of this invention.

Thus, it may be seen that the present invention has important advantages over known prior art liquid filtered smoking devices in that the same is provided with a unique filter means which positively and effectively prevents the deposition of ash and tobacco products within the liquid filterming medium so as not to defile and pollute the same. The filter may be utilized in conjunction with both reversible and non-reversible smoking bowls and the same may be readily separated or removed from the smoking device for cleaning purposes. In addition, the filter may be removed during smoking of the tobacco for the purpose of recovering unburnt or partially burnt tobacco and to facilitate further combustion and smoking of the same.

Obviously, many modifications and variations of the present invention are possible in light of the above teachings. It is to be understood therefore that within the scope of the appended claims, the present invention may be practiced otherwise than as specifically described herein.

What is claimed is:

1. A liquid filter smoking device, comprising:

a container having an opening at one end thereof and having a liquid filtering medium therein;

a hollow tube open at both ends, one of said ends being inserted into said container and immersed within said liquid filtering medium while the other end projects outwardly of said container;

a smoking bowl having one end disposed upon said other end of said hollow tube, for retaining smoking tobacco therewithin and for permitting smoke to pass therefrom into said tube;

filter means disposed within said bowl for retaining ash and tobacco material within said smoking bowl; and said filter means comprises:

an annular ring member;

a radially inwardly-projecting annular ring portion integrally connected to the bottom of said ring member; and a disc-type filter medium having a diametrical extent, small enough so as to permit said filter medium to be disposed within said ring member and large enough so as to permit said filter medium to rest upon, and be supported by, said ring portion, whereby smoke is permitted to pass from said smoking bowl into said tube, and liquid filtering medium, said container and out of said opening, while said ash and tobacco material is prevented from passing into said tube and liquid filtering medium.

2. A smoking device as set forth in claim 1, wherein said hollow tube is cylindrical.

3. A smoking device as set forth in claim 2, wherein said smoking bowl is a non-reversible smoking bowl.

4. A smoking device as set forth in claim 3, wherein said filter means is seated upon said other end of said hollow tube.

5. A smoking device as set forth in claim 2, wherein said smoking bowl is a reversible smoking bowl, having a large and a small smoking tobacco compartment whereby different predetermined quantities of tobacco may be smoked.

6. A smoking device as set forth in claim 5, wherein said filter means is seated upon said other end of said tube and within said one end of said bowl.

7. A smoking device as set forth in claim 6, wherein a second filter means is disposed within the other end of said bowl.

8. A smoking device as set forth in claim 5, wherein said filter means is disposed within the end of said bowl which is not disposed upon said hollow tube.

9. A smoking device as set forth in claim 2, wherein said filter means is seated upon said other end of said hollow tube.

10. A smoking device as set forth in claim 1, wherein said filter medium is wire screen mesh.

* * * * *